US008256867B2

(12) United States Patent
Makimoto

(10) Patent No.: US 8,256,867 B2
(45) Date of Patent: Sep. 4, 2012

(54) RECORDING APPARATUS

(75) Inventor: Akihiro Makimoto, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 182 days.

(21) Appl. No.: 12/884,934

(22) Filed: Sep. 17, 2010

(65) Prior Publication Data

US 2011/0069103 A1 Mar. 24, 2011

(30) Foreign Application Priority Data

Sep. 18, 2009 (JP) ..... 2009-217761

(51) Int. Cl.
*B41J 29/38* (2006.01)
*B41J 2/01* (2006.01)

(52) U.S. Cl. ..... 347/16; 347/101; 347/104

(58) Field of Classification Search ..... None
See application file for complete search history.

(56) References Cited

U.S. PATENT DOCUMENTS 5,606,357 A * 2/1997 Bekki ..... 347/104
5,847,719 A * 12/1998 Yamaguchi et al. ..... 346/134
6,089,773 A * 7/2000 Bailey et al. ..... 400/642
6,824,264 B2 11/2004 Shima et al.

FOREIGN PATENT DOCUMENTS

JP 2004-181816 A 7/2004
JP 2007-196417 A 8/2007

* cited by examiner

*Primary Examiner* — Geoffrey Mruk
(74) *Attorney, Agent, or Firm* — Birch, Stewart, Kolasch & Birch, LLP

(57) ABSTRACT

The recording apparatus includes: an image forming device which deposits ink onto a recoding medium to form an image; a conveyance device which conveys the recording medium in a recording medium conveyance direction at a recording medium conveyance speed; a pressing member which presses the recording medium on which the ink has been deposited, onto the conveyance device; and a pushing device which pushes the pressing member to press the recording medium to suppress cockling occurring in the recording medium on which the ink has been deposited, the pushing device having a spring constant k that satisfies:

$$\frac{48EI}{(1/f)^3} < k < \sqrt{v} \cdot \frac{2A}{t} \cdot \frac{48EI}{(1/f)^3},$$

where EI is a flexural rigidity of the recording medium, t is a thickness of the recording medium, v is the recording medium conveyance speed, A is an amplitude of the cockling in the recording medium, and f is a frequency of the cockling in the recording medium along the recording medium conveyance direction.

20 Claims, 7 Drawing Sheets

RECORDING APPARATUS

BACKGROUND OF THE INVENTION

1. Field of the Invention

The present invention relates to a recording apparatus, and more particularly to a recording apparatus which forms an image by depositing droplets of ink onto paper forming a recording medium.

2. Description of the Related Art

If a porous base material is used as a supporting body in an inkjet paper (recording medium) which is used in an inkjet printer, for example, then ink permeates into the supporting body, and cockling (wrinkling) occurs due to the swelling and easing of stress in the paper fibers caused by absorption and drying of the ink solvent in the recorded image area, and thereby image quality declines greatly, smoothness and luster decline, and print-through to the rear side occurs.

In response to the problem of cockling of this kind, in order to suppress cockling in an inkjet printing method which uses a water-based ink, for example, there is known a one-pass printing method which carries out printing by supplying the water-based ink to a fixed long head and emitting a water-based inkjet ink from the ink head onto normal paper which is conveyed on a conveyance table, in which a device for pressing the normal paper immediately after all of the ink from the ink head has been deposited is arranged (see, for example, Japanese Patent Application Publication No. 2007-196417).

Furthermore, technology is also known according to which, even in the case of using a recording medium having a base member made of a material that is sensitive to heat, such as resin, for example, in order to remove the deformation, such as wrinkling, occurring in the recording medium during heating by the heating and fixing unit, before the recording medium is cooled, a pressing roller mechanism is arranged which presses against the surface of the recording medium in a state of heated conveyance in the output region of the heating and fixing unit and at least one roller constituting the pressing roller mechanism is composed in such a manner that it can be advanced toward and retracted from the surface of the recording medium (see, for example, Japanese Patent Application Publication No. 2004-181816).

However, in the above-described related art, although the range of pressing force of the pressing device (roller) for suppressing cockling is limited, the cockling may be suppressed excessively depending on the rigidity (width and thickness) of the paper and the extent of the existing cockling, and there is a risk of adversely producing severe creasing.

SUMMARY OF THE INVENTION

In this respect, it might be considered desirable to make the pressing member capable of following the shape of the cockling to a certain level.

The present invention has been contrived in view of these circumstances, an object thereof being to provide a recording apparatus whereby cockling of a recording medium which occurs due to the deposition of ink can be suppressed appropriately without causing severe creasing due to excessive suppression.

In order to attain the aforementioned object, the present invention is directed to a recording apparatus, comprising: an image forming device which deposits ink onto a recoding medium to form an image; a conveyance device which conveys the recording medium in a recording medium conveyance direction at a recording medium conveyance speed; a pressing member which presses the recording medium on which the ink has been deposited, onto the conveyance device; and a pushing device which pushes the pressing member to press the recording medium to suppress cockling occurring in the recording medium on which the ink has been deposited, the pushing device having a spring constant k that satisfies:

$$\frac{48EI}{(1/f)^3} < k < \sqrt{v} \cdot \frac{2A}{t} \cdot \frac{48EI}{(1/f)^3},$$

where EI is a flexural rigidity of the recording medium, t is a thickness of the recording medium, v is the recording medium conveyance speed, A is an amplitude of the cockling in the recording medium, and f is a frequency of the cockling in the recording medium along the recording medium conveyance direction.

According to this aspect of the present invention, it is possible to suppress the cockling in the recording medium which occurs due to deposition of the ink, in a suitable manner so as not to produce severe creasing as a result of excessive suppression. The image described here is not limited only to picture images, and can also include text characters, or the like.

The pressing member can be constituted of an elastic member, a rubber roller or a metal roller.

Preferably, the pressing member is constituted of a fixing roller which applies heat to the recording medium to fix the image formed on the recording medium.

Preferably, a temperature of the fixing roller is adjustable by means of a heat source disposed inside and/or outside the fixing roller.

According to these aspects of the present invention, since the pushing member makes the pressing member press the recording medium, then the pressing member can be a simple roller or an elastic member, a typical example of which is a rubber roller. Furthermore, in particular, it is possible to employ the fixing roller which fixes the printed image to the recording medium by applying heat, as the pressing member.

Preferably, the recording apparatus further comprises a pushing force control device which adjusts a pushing force of the pushing device to control a pressing force of the pressing member applied to the recording medium.

Preferably, the pushing device is constituted of a compressive spring.

Preferably, the recording apparatus further comprises a compression amount control device which adjusts an amount of compression of the compressive spring to control a pressing force of the pressing member applied to the recording medium.

In this way, by using a compressive spring as the pushing member, then it is possible to easily adjust the pressing force of the pressing member applied to the recording medium, by adjusting the compression amount of the spring.

It is also preferable that the pushing device is constituted of a pneumatic spring.

Preferably, the recording apparatus further comprises a pump control device which adjusts amount of air in the pneumatic spring to control a pressing force of the pressing member applied to the recording medium.

Preferably, the recording apparatus further comprises a spring constant value calculation device which receives image data of the image to be formed on the recording medium, predicts the amplitude and frequency of the cockling occurring after the ink is deposited to form the image in accordance with the image data, and calculates a spring constant value corresponding to the predicted amplitude and frequency of the cockling.

In this way, by predicting the amplitude and frequency of the cockling which is to occur subsequently on the basis of the received image data, it is possible to more suitably suppress cockling while preventing the occurrence of severe creasing.

Preferably, the recording apparatus further comprises a reporting device which reports the calculated spring constant value to a user.

Preferably, the spring constant of the pushing device is manually adjustable by the user in accordance with the calculated spring constant value.

Preferably, the pushing device is constituted of a pneumatic spring of which the spring constant is manually adjustable by the user in accordance with the calculated spring constant value.

It is also preferable that the spring constant of the pushing device is automatically adjusted in accordance with the calculated spring constant value.

Preferably, the pushing device is constituted of a pneumatic spring of which the spring constant is automatically adjusted in accordance with the calculated spring constant value.

According to this aspect of the present invention, it is possible to more suitably suppress cockling.

The spring constant k of the pushing device preferably satisfies:

$$0.5 \cdot \sqrt{v} \cdot \frac{2A}{t} \cdot \frac{48EI}{(1/f)^3} \leq k,$$

more preferably $$0.8 \cdot \sqrt{v} \cdot \frac{2A}{t} \cdot \frac{48EI}{(1/f)^3} \leq k.$$

As described above, according to the present invention, it is possible to suitably suppress cockling, which occurs due to the deposition of ink, without producing severe creasing due to excessive suppression.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
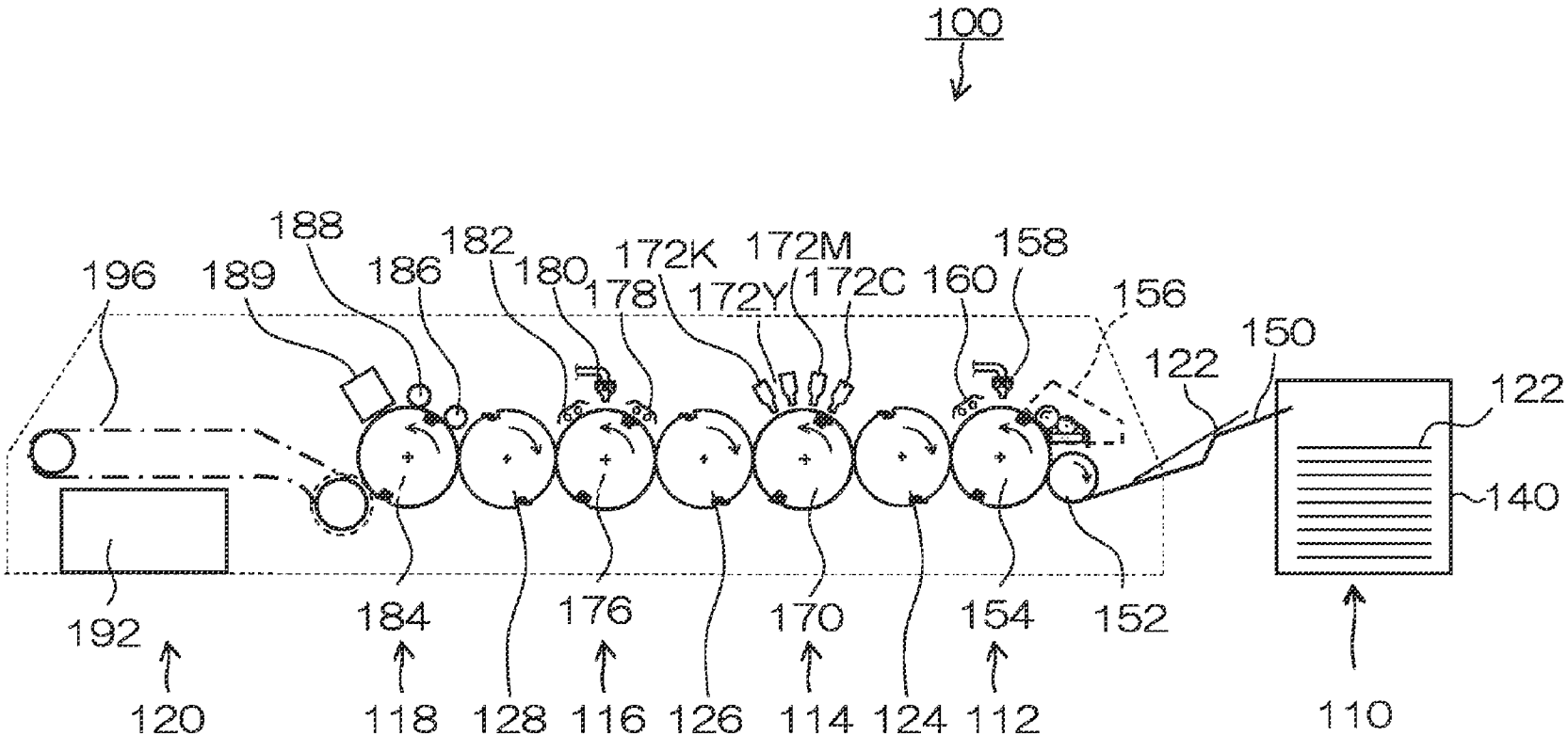
FIG. 1 is a schematic drawing of an inkjet recording apparatus which is one embodiment of a recording apparatus relating to the present invention.

FIG. 1 is a schematic drawing of an inkjet recording apparatus as a recording apparatus according to an embodiment of the present invention.

As shown in FIG. 1, the inkjet recording apparatus 100 includes: a paper supply unit 110, which supplies recording medium 122; a treatment liquid deposition unit 112, which deposits a prescribed treatment liquid onto a recording surface of the recording medium 122 supplied from the paper supply unit 110; a printing unit 114, which forms an image by ejecting and depositing ink droplets onto the recording surface of the recording medium 122 on which the treatment liquid has been deposited; a drying unit 116, which dries the recording surface of the recording medium 122 on which the image has been formed; a fixing unit 118, which fixes the image formed on the recording surface; and a paper output unit 120, where the recording medium 122 on which the image has been recorded is collected.

The paper supply unit 110 has a magazine 140, which accommodates the recording medium 122. The recording medium 122 is supplied to a paper feed tray 150, one sheet at a time, from the magazine 140. The recording medium 122 supplied to the paper feed tray 150 is transferred to a treatment liquid drum 154 of the treatment liquid deposition unit 112 through a transfer drum 152.

The treatment liquid drum 154 receives the recording medium 122 transferred from the transfer drum 152, and conveys and transfers the recording medium 122 by rotation to a first intermediate transfer drum 124. In the treatment liquid deposition unit 112, the prescribed treatment liquid is deposited to a uniform thickness on the recording medium 122 that is conveyed by rotation on the treatment liquid drum 154. The treatment liquid is deposited by means of a treatment liquid deposition device 156, which deposits the treatment liquid by, for example, pressing an application roller, on the surface of which the treatment liquid has been deposited, against the recording surface of the recording medium 122; however, the treatment liquid deposition device 156 is not limited to this. For instance, the treatment liquid can also be deposited by being ejected from a head similar to an ink head which is described below. The recording medium 122 on which the treatment liquid has been deposited is then dried by a drier 158 and heater 160, before being transferred onto the first intermediate conveyance drum 124.

The treatment liquid deposited by the treatment liquid deposition unit 112 contains a component that aggregates or increases the viscosity of the coloring material (pigment or dye) in the ink deposited by the printing unit 114 at a later stage. By depositing treatment liquid of this kind to the recording surface of the recording medium 122 before depositing droplets of ink, it is possible to prevent bleeding, and the like, and an image of high quality can be printed.

The first intermediate conveyance drum 124 receives the recording medium 122 transferred from the treatment liquid drum 154, and conveys and transfers the recording medium 122 by rotation to a print drum 170 of the printing unit 114.

The print drum 170 receives the recording medium 122 transferred from the first intermediate conveyance drum 124, and conveys and transfers the recording medium 122 by rotation to a second intermediate conveyance drum 126. In the printing unit 114, an image is printed by ejecting and depositing ink droplets from inkjet heads (hereinafter also referred to as "ink heads") 172C, 172M, 172Y and 172K of respective colors of cyan, magenta, yellow and black, onto the recording medium 122 that is conveyed by rotation on the print drum 170.

The ink heads 172C, 172M, 172Y and 172K are disposed to face the print drum 170 at a prescribed interval from same, and are arranged in the order, cyan, magenta, yellow and black, from the upstream side in terms of the direction of rotation of the print drum 170. The ink heads 172C, 172M, 172Y and 172K are constituted of line heads and are formed so as to correspond to the recording width of the recording medium 122.

Figure 2:
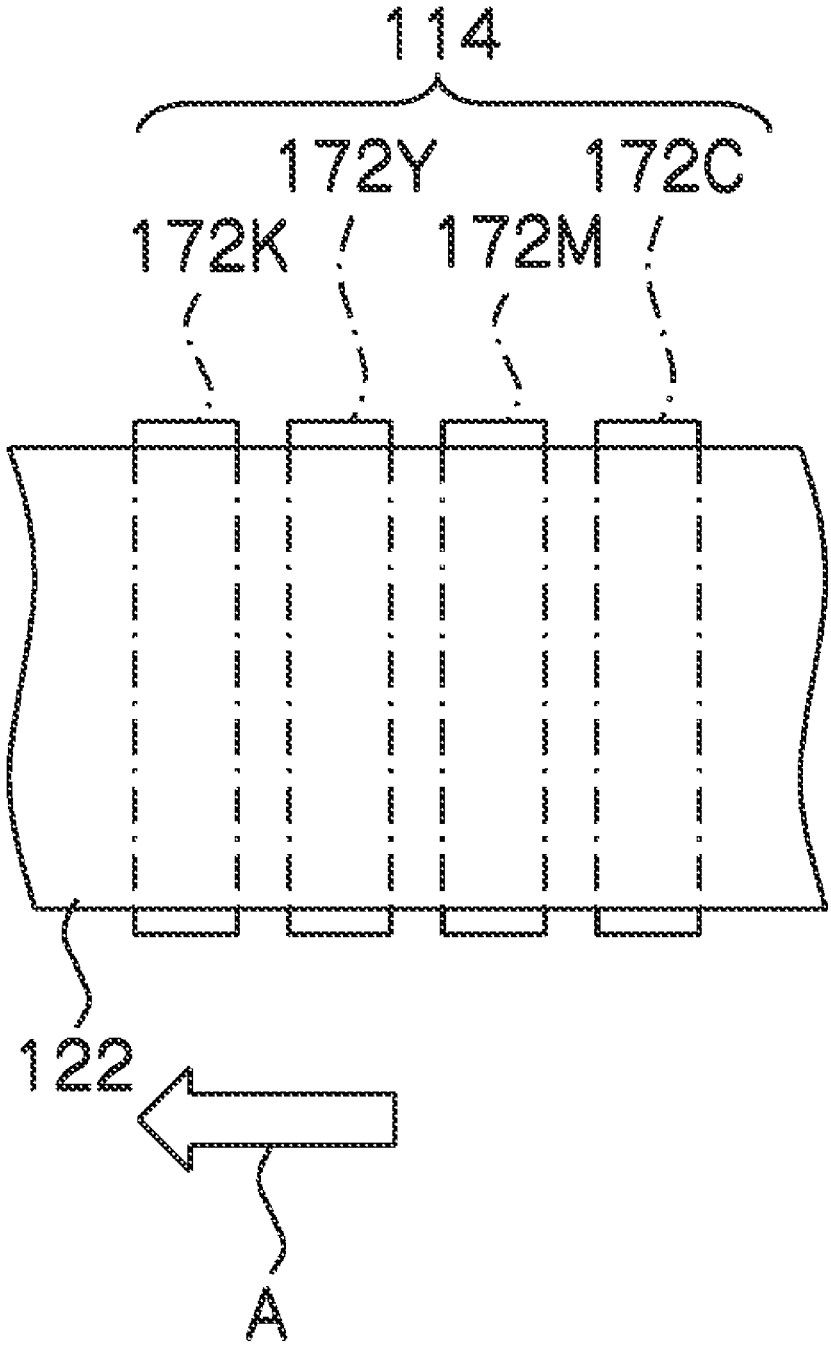
FIG. 2 is a principal plan diagram showing the peripheral area of a printing unit of an inkjet recording apparatus.

FIG. 2 is a principal plan diagram showing the periphery of the printing unit 114 of the inkjet recording apparatus 100.

As shown in FIG. 2, the printing unit 114 has so-called full line type of heads, which have a length corresponding to the maximum width of the image forming region on the recording medium 122, in which the ink heads 172C, 172M, 172Y and 172K are disposed in a direction (main scanning direction), which is perpendicular to the paper conveyance direction (sub-scanning direction) indicated with an arrow A in FIG. 2.

The ink heads 172C, 172M, 172Y and 172K are constituted of line heads in which a plurality of ink ejection ports (nozzles) are arranged through a length exceeding at least a dimension of one edge of the maximum size recording medium 122 intended for use with the inkjet recording apparatus 100.

The ink heads 172C, 172M, 172Y and 172K corresponding to the respective colors of ink are arranged in the order cyan (C), magenta (M), yellow (Y) and black (K) from the upstream side (the right-hand side in FIG. 2) following the conveyance direction of the recording medium 122 (indicated with the arrow A in FIG. 2). A color print can be formed on the recording medium 122 by ejecting and depositing the colored inks respectively from the heads 172C, 172M, 172Y and 172K to the recording medium 122 while conveying the recording medium 122.

As described above, by adopting the printing unit 114 in which the full line heads covering the full paper width are provided for the respective colors, it is possible to record an image on the full surface of the recording medium 122 by performing just one operation of relatively moving the recording medium 122 and the printing unit 114 in the paper conveyance direction (the sub-scanning direction), in other words, by means of a single sub-scanning action. Higher-speed printing is thereby made possible and productivity can be improved in comparison with a shuttle (serial) type head in which a printing head reciprocates in a direction (main scanning direction) that is perpendicular to the paper conveyance direction.

Referring again to FIG. 1, the recording medium 122 on which the ink droplets have been deposited by the ink heads 172C, 172M, 172Y and 172K is transferred from the print drum 170 to the second intermediate conveyance drum 126. The second intermediate drum 126 receives the recording medium 122 transferred from the print drum 170, and conveys and transfers the recording medium 122 by rotation to a drying drum 176 of the drying unit 116.

The drying drum 176 receives the recording medium 122 transferred from the second intermediate conveyance drum 126, and conveys and transfers the recording medium 122 by rotation to a third intermediate conveyance drum 128. In the drying unit 116, the recording medium 122 that is conveyed by rotation on the drying drum 176 is dried by first and second heaters 178 and 182 and a drier 180.

The recording medium 122 that has been dried is transferred from the drying drum 176 to the third intermediate conveyance drum 128. The third intermediate conveyance drum 128 receives the recording medium 122 transferred from the drying drum 176, and conveys and transfers the recording medium 122 by rotation to the fixing drum 184 of the fixing unit 118.

The fixing drum 184 receives the recording medium 122 transferred from the third intermediate conveyance drum 128, and conveys and transfers the recording medium 122 by rotation to a conveyor 196 of the paper output unit 120. In the fixing unit 118, the printed image is fixed onto the recording medium 122 that is conveyed by rotation on the fixing drum 184, by applying heat and pressure to the recording medium 122 by means of first and second fixing rollers 186 and 188, which are composed so as to be temperature adjustable by means of heat sources arranged inside and outside the first and second fixing rollers 186 and 188.

In the present embodiment, when suppressing undulation (cockling) which occurs in the recording medium 122 by applying pressure to the recording medium 122 after printing with a pressing member, the pressing force of the pressing member against the recording medium 122 is controlled in order to prevent the applied pressure (pressing force) of the pressing member against the recording medium 122 from becoming excessively large and adversely causing wrinkles in the recording medium 122.

As the pressing member of this kind, an elastic member such as a rubber roller, for example, can be disposed separately with respect to the conveyance roller, so as to apply pressure to the recording medium 122, but here, the first and second fixing rollers 186 and 188 (both or either one of the rollers) are also employed as the pressing member, and details thereof are described later.

The fixing unit 118 further includes an in-line sensor 189, which reads in the print results achieved by the printing unit 114. The in-line sensor 189 includes an image sensor (line sensor, or the like), for capturing an image of the print results of the printing unit 114 (the droplet deposition results of the ink heads 172C, 172M, 172Y and 172K), and a check is made for nozzle blockages and other ejection defects on the basis of the droplet deposition image read in by the image sensor.

The in-line sensor 189 is constituted of a line CCD in which a plurality of detection pixels (reading elements) are arranged in one line following the breadthways direction of the recording medium 122 (or an area sensor in which a plurality of detection pixels are arranged in a two-dimensional configuration), and a condensing lens which is arranged in such a manner that the breadth of the recording medium 122 can be read in a single action by the line CCD (or area sensor). The in-line sensor 189 has a reading resolution lower than the recording resolution of the ink heads 172C, 172M, 172Y and 172K of the printing unit 114.

The recording medium 122 on which the image has been fixed is transferred to a conveyor 196 of the print output unit 120 from the fixing drum 184. The conveyor 196 receives the recording medium 122 from the fixing drum 184, and conveys the recording medium 122 to a paper output tray 192 arranged in the paper output unit 120, where the recording medium is collected.

According to the inkjet recording apparatus 100 having the composition described above, since stable ink ejection can be performed from the respective inkjet heads (ink heads) in the printing unit 114, then it is possible to achieve stable image formation.

Next, the structure of the ink heads 172C, 172M, 172Y and 172K arranged in the printing unit 114 is described. The ink heads 172C, 172M, 172Y and 172K have a common structure, and therefore a representative ink head is hereinafter denoted with a reference numeral 12.

Figure 3:
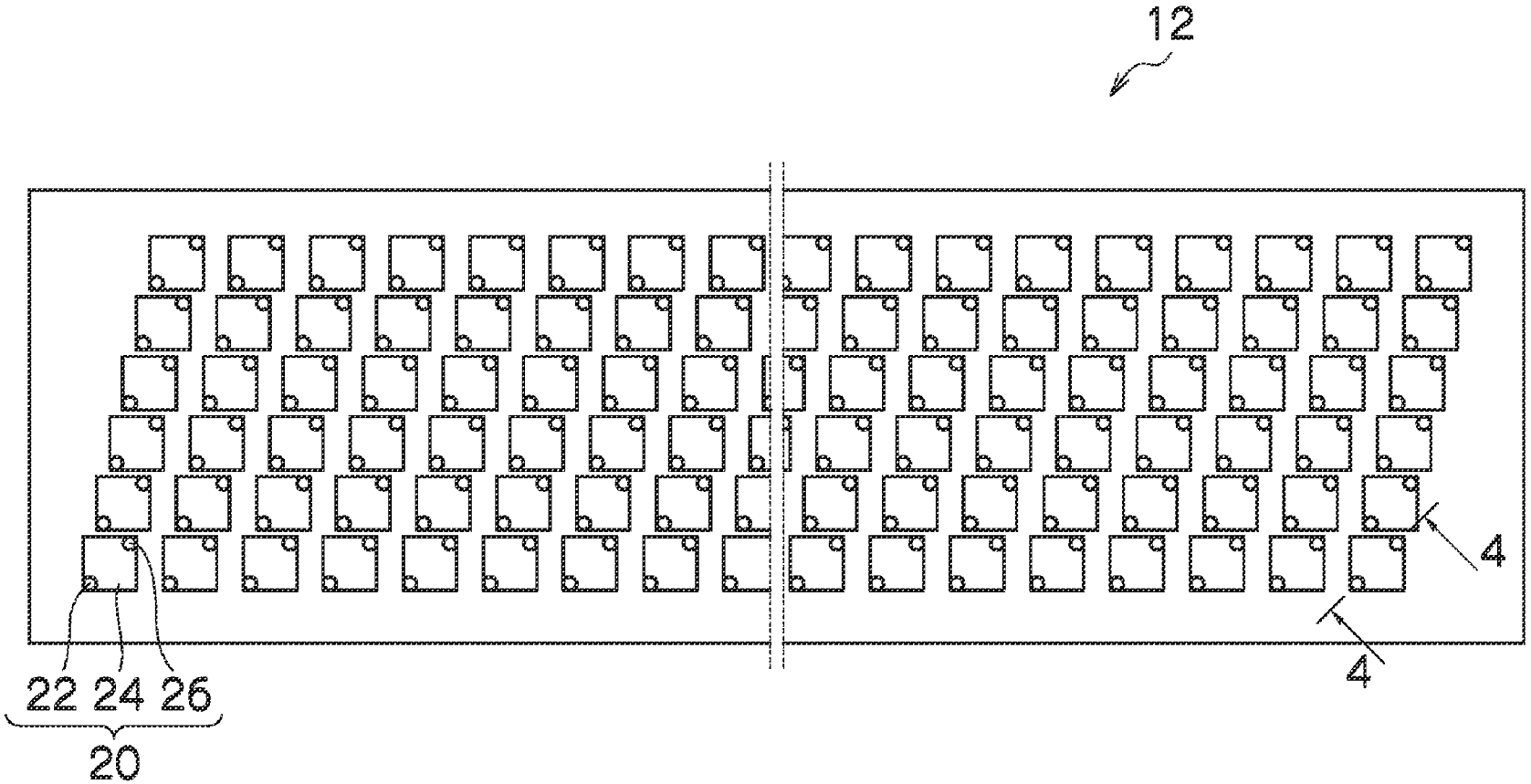
FIG. 3 is a plan view perspective diagram showing an embodiment of the structure of a head.

FIG. 3 is a plan view perspective diagram showing an embodiment of the structure of an ink head 12.

As shown in FIG. 3, in the ink head 12, pressure chamber units 20, which eject ink in the form of droplets through nozzles 22 by applying pressure to the ink, are arranged in a two-dimensional configuration according to a prescribed arrangement pattern (in the present embodiment, a staggered matrix configuration), and furthermore, ink flow channels (not shown) for supplying the ink to the respective pressure chamber units 20 are arranged at high density.

Each of the pressure chamber units 20 includes: the nozzle 22, from which the ink is ejected in the form of a droplet; a pressure chamber 24, which stores the ink and ejects the ink in the form of droplets through the nozzle 22 by applying pressure to the stored ink; and an ink supply port 26, which supplies (introduces) the ink into the pressure chamber 24. In the present embodiment, as shown in FIG. 3, the planar shape of the pressure chamber 24 is a square shape, the nozzle 22 being formed at one end of the diagonal thereof and the ink supply port 26 being formed at the other end thereof. The ink is supplied to the pressure chamber 24 from a common flow channel (see FIG. 4) through the ink supply port 26, pressure is applied to the ink in the pressure chamber 24 and the ink is ejected as a droplet from the nozzle 22.

Figure 4:
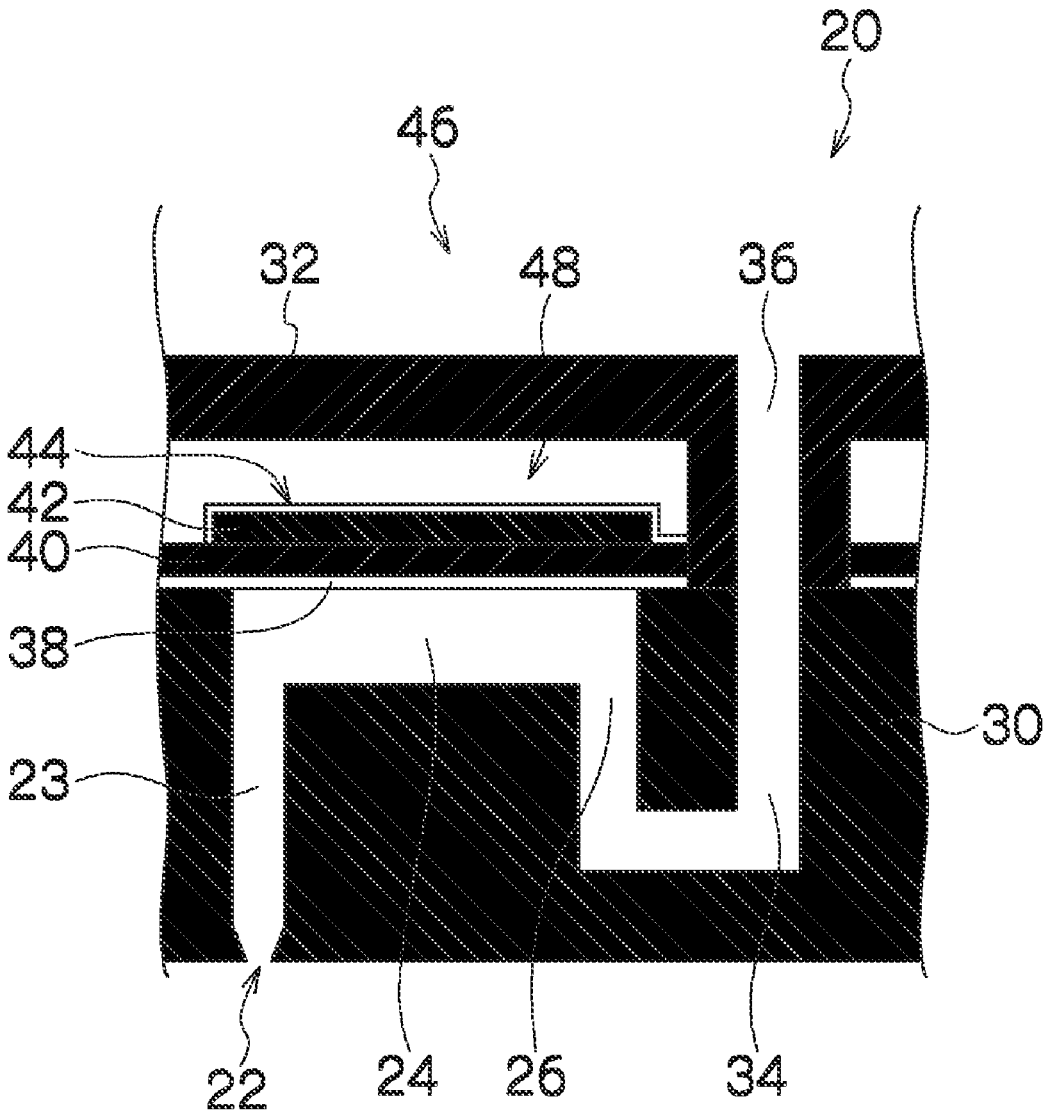
FIG. 4 is a vertical cross-sectional diagram along line 4-4 in FIG. 3 showing the general composition of a pressure chamber unit.

FIG. 4 is a longitudinal cross-sectional diagram along line 4-4 in FIG. 3 showing the approximate composition of the pressure chamber unit 20, and this cross-section shows the three-dimensional structure of the pressure chamber unit 20.

As shown in FIG. 4, the pressure chamber units 20 of the ink head 12 according to the present embodiment are formed by bonding a lower substrate 30 with an upper substrate 32. In FIG. 4, each of the lower substrate 30 and the upper substrate 32 is depicted as being constituted of one substrate, but each can be constituted of a plurality of substrates stacked together.

The pressure chamber 24, nozzle flow channel 23, nozzle 22, lower ink supply channel 34 and ink supply port 26 are formed in the lower substrate 30. The upper surface (ceiling) of each pressure chamber 24 is constituted of a diaphragm 38, and the diaphragm 38 also serves as a common electrode, on which a piezoelectric element (PZT) 40 is formed. An upper electrode (individual electrode) 42 is formed on the piezoelectric element 40, and a resin protective film 44 is formed on the upper electrode 42. An upper ink supply channel 36 is formed in the upper substrate 32, and a common liquid chamber 46 is arranged over the upper portion of the upper substrate 32. By bonding the upper substrate 32 to the lower substrate 30, the upper ink supply channel 36 and the lower ink supply channel 34 are connected together, and a space 48 for deformation of the piezoelectric element 40 is formed.

The ink passes through the upper ink supply channel 36 and the lower ink supply channel 34 from the common liquid chamber 46 over the upper substrate 32, and is supplied to the pressure chamber 24 through the ink supply port 26.

By applying a drive voltage between the upper electrode 42 and the diaphragm 38, which also serves as the common electrode, the piezoelectric element 40 deforms and applies pressure to the ink inside the pressure chamber 24, whereby the ink inside the pressure chamber 24 passes through the nozzle flow channel 23 and is ejected in the form of droplet from the nozzle 22. At this time, the space 48 is created as described above by the upper substrate 32 over the piezoelectric element 40 (and the upper electrode 42), and hence deformation of the piezoelectric element 40 is possible.

There follows a description of the pressing force control mechanism of the pressing member, which applies pressure to the recording medium 122 in order to suppress undulation (cockling) that occurs in the recording medium 122 and which is the essence of the present invention; in the present embodiment, the first fixing roller 186 serves as this pressing member.

Figure 5:
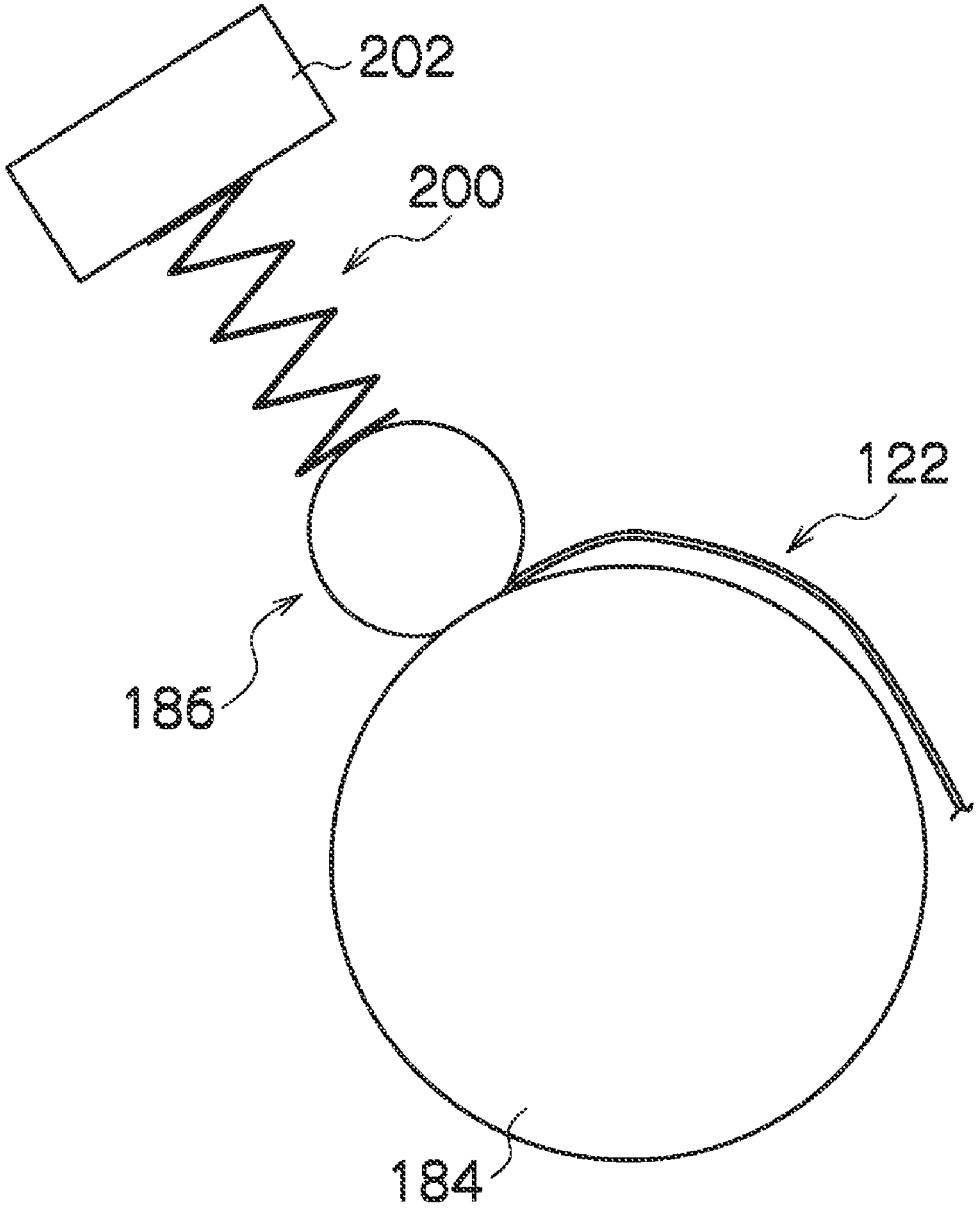
FIG. 5 is an enlarged diagram showing the periphery of a first fixing roller which serves as a pressing member.

FIG. 5 shows an enlarged view of the periphery of the first fixing roller 186. FIG. 5 serves to describe the pressing force control mechanism of the pressing member and for the sake of convenience, the arrangement position of the first fixing roller 186 is different from that shown in FIG. 1 and furthermore the second fixing roller 188 and the in-line sensor 189, and the like, are not depicted.

The first fixing roller 186 fixes the printed image by applying heat and pressure to the recording medium 122 when the recording medium 122 passes between the first fixing roller 186 and the fixing drum 184. The first fixing roller 186 is, for example, an elastic member such as a rubber roller, which is composed so as to be temperature adjustable by means of a heat source (not shown) arranged inside and outside the roller.

The mechanism to control the pressing force of the first fixing roller 186 is provided with a compressive spring 200 serving as a pushing member, and a compression amount control unit 202 for controlling the amount of compression of the compressive spring 200. The first fixing roller 186 is pressed by the compressive spring 200 onto the fixing drum 184, which conveys the recording medium 122 that has been dried by the drying unit 116 after deposition of the ink droplets, and thereby applies heat and pressure to the recording medium 122 that is conveyed therebetween. Thus, the image printed on the recording medium 122 is fixed and undulation (cockling) that occurs in the recording medium 122 is suppressed.

In order to control the pressing force of the compressing spring 200 with respect to the first fixing roller 186 in such a manner that the first fixing roller 186 is not pressed too hard, the amount of compression of the compressive spring 200 is adjusted by means of the compression amount control unit 202.

The control of the pressing force is described in detail later.

Figure 6:
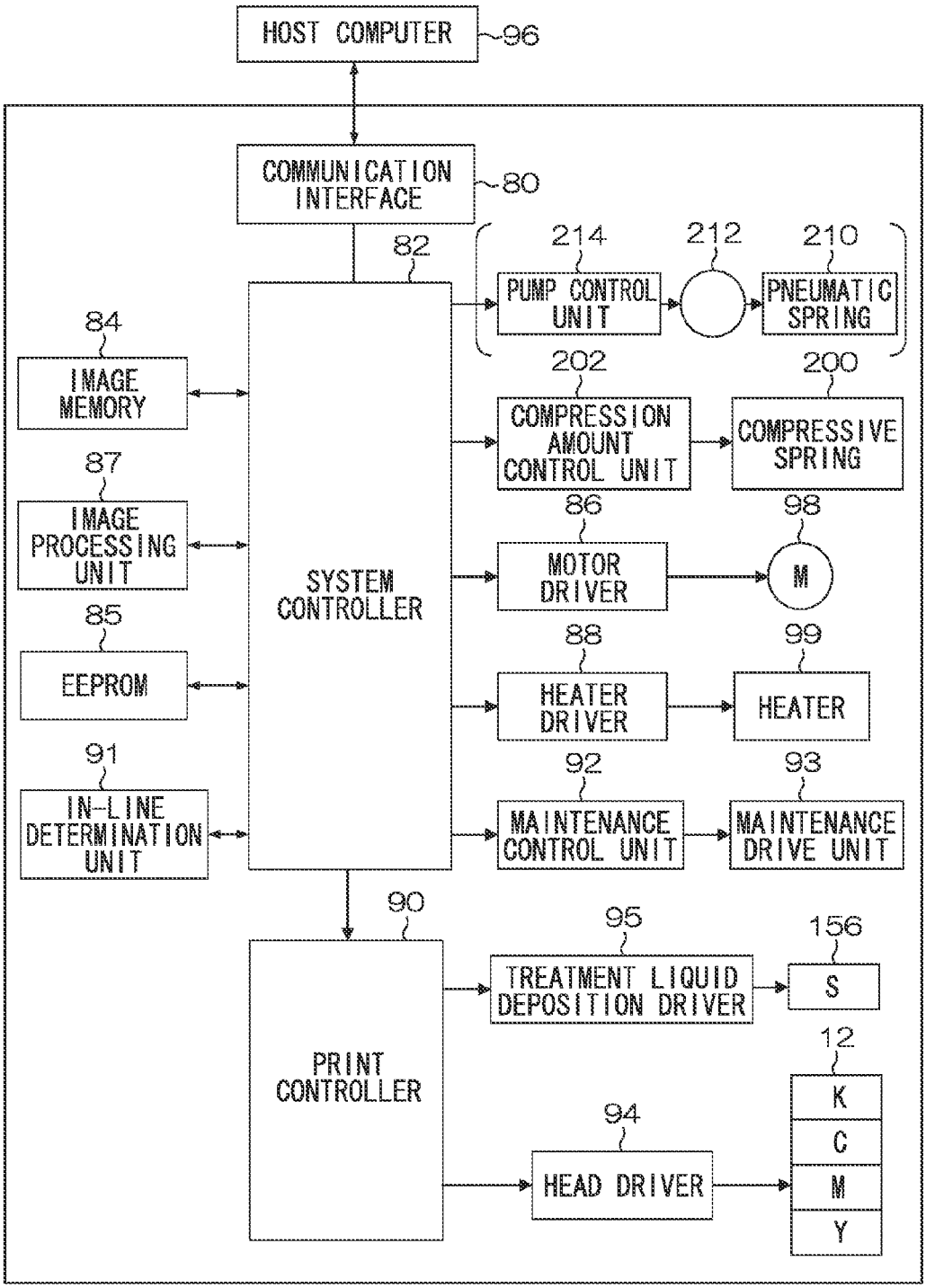
FIG. 6 is a principal block diagram showing the system composition of the inkjet recording apparatus.

FIG. 6 is a principal block diagram showing the system composition of the inkjet recording apparatus 100.

The inkjet recording apparatus 100 includes a communication interface 80, a system control unit (system controller) 82, an image memory 84, a motor driver 86, a heater driver 88, a print controller 90, a maintenance control unit 92, a head driver 94, and the like.

The communication interface 80 is an interface unit for receiving image data sent from a host computer 96. A serial interface such as Universal Serial Bus (USB), IEEE1394, Ethernet, wireless network, or a parallel interface such as a Centronics interface can be used as the communication interface 80. The communication interface 80 can be provided with a buffer memory in order to increase the communication speed. The image data sent from the host computer 96 is received by the inkjet recording apparatus 100 through the communication interface 80, and is temporarily stored in the image memory 84.

The image memory 84 is a storage device for temporarily storing the images inputted through the communication interface 80, and data is written and read through the system controller 82. The image memory 84 is not limited to a memory composed of semiconductor elements, and a hard disk drive or another magnetic medium can be used.

The system controller 82 is constituted of a central processing unit (CPU) and peripheral circuits thereof, and the like, and the system controller 82 functions as a control device for controlling the whole of the inkjet recording apparatus 100 in accordance with a prescribed program, as well as a calculation device for performing various calculations. More specifically, the system controller 82 controls the various sections, such as the communication interface 80, image memory 84, motor driver 86 and heater driver 88, and generates control signals for controlling communication with the host computer 96, and a heater 99.

The image memory 84 can store the program executed by the CPU of the system controller 82 and the various types of data which are required for control procedures. The image memory 84 can be a non-rewritable storage device, or a rewritable storage device, such as an EEPROM. The image memory 84 can be used as a temporary storage region for the image data, and can also be used as a program development region and a calculation work region for the CPU.

The system controller 82 is further connected to an EEPROM 85, which stores various control programs, and an image processing unit 87, which performs various image processes in respect of the image data. A control program is read in from the EEPROM 85 and executed in accordance with an instruction from the system controller 82. The EEPROM 85 can also serve as a storage device for operating parameters, and the like.

The motor driver 86 drives a motor 98 in accordance with instructions from the system controller 82. In FIG. 6, the motors (actuators) which are disposed in the respective sections of the inkjet recording apparatus 100 are represented with the reference numeral 98. For example, the motor 98 shown in FIG. 6 includes the motors which drive the intermediate conveyance drums 124, 126 and 128, the transfer drum 152, the treatment liquid drum 154, the print drum 170, the drying drum 176, the fixing drum 184, and the like, which are shown in FIG. 1.

The heater driver 88 drives the heater 99 in accordance with instructions from the system controller 82. In FIG. 6, a plurality of heaters arranged in the inkjet recording apparatus 100 are represented with the reference numeral 99. For example, the heater 99 shown in FIG. 6 includes the heater 160 of the treatment liquid deposition unit 112, and the heaters 178 and 182 of the drying unit 116, which are shown in FIG. 1.

The system controller 82 is further connected to the maintenance controller 92. The maintenance controller 92 controls a maintenance drive unit 93, which drives a maintenance unit including a cap and a cleaning blade (not shown) in accordance with instructions from the system controller 82.

The print controller 90 has a signal processing function for carrying out various processing, such as shaping and correction, and the like, in order to generate a print control signal from the image data in the image memory 84, in accordance with the control of the system controller 82. Prior to the start of printing, the print controller 90 also controls a treatment liquid deposition driver 95 to deposit the treatment liquid onto the recording medium 122 from the treatment liquid deposition device 156, as well as supplying the generated print data (dot data) to the head driver 94. Prescribed signal processing is carried out in the print controller 90, and the ejection volume (volume of ink droplets to be deposited) and the ejection timing of the ink droplets in the ink head 12 are controlled through the head driver 94 on the basis of the image data. Thus, desired dot size and dot arrangement are achieved.

An in-line determination unit 91 carries out ejection failure determination for judging nozzles suffering ejection abnormalities, on the basis of the information obtained from the in-line sensor 189.

When the in-line determination unit 91 carries out ejection failure determination, as well as determining ejection failure nozzles, if the ejection failure nozzles in question can be corrected by image correction, then the in-line determination unit 91 sends control signals to the respective sections through the system controller 82 in order to implement the image correction. If it is not possible to remedy the abnormality by means of image correction, then a control signal is sent to the respective units through the system controller 82 in such a manner that preliminary ejection or suction is carried out in respect of the nozzle suffering ejection abnormality.

As shown in FIG. 6, the system controller 82 is further connected to the compression amount control unit 202, which adjusts the amount of compression of the compressive spring 200. The compression amount control unit 202 controls the pushing force of the compressive spring 200 applied to the first fixing roller 186 by adjusting the amount of compression of the compressive spring 200, so as to control the pressing force applied to the recording medium 122 passing between the first fixing roller 186 and the fixing drum 184.

More specifically, the compressive spring 200 serving as the pushing member has the spring constant k (N/mm) in the direction of the recording medium 122 that is set to satisfy the conditions in the following Expression 1:

$$\frac{48EI}{(1/f)^3} < k < \sqrt{v} \cdot \frac{2A}{t} \cdot \frac{48EI}{(1/f)^3}, \tag{1}$$

where EI ($N \cdot mm^2$) is the flexural rigidity of the recording medium 122, t (mm) is the thickness of the recording medium 122, v (mm/s) is the conveyance speed of the recording medium 122, A (mm) is the amplitude of the cockling occurring in the recording medium 122, and f (1/mm) is the frequency of the cockling in the conveyance direction of the recording medium 122.

As described above, cockling is a phenomenon whereby undulations (wrinkles) occur in a recording medium when using the recording medium that has a porous base material, such as paper, as the supporting body, due to swelling and easing of stress in the paper fibers occurring due to absorption and drying of the ink solvent that has permeated into the supporting body in the area of the recorded image.

Figure 7:
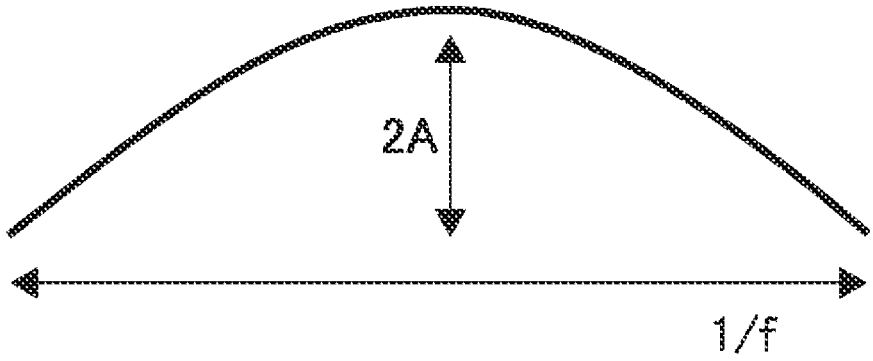
FIG. 7 is an explanatory diagram in which cockling is represented as a simple supported beam.

If cockling is regarded as a simple supported beam such as that shown in FIG. 7, plotting the frequency (1/f) of the undulations (wrinkles) in the conveyance direction of the recording medium 122 on the horizontal axis and the amplitude (2 A) thereof on the vertical axis, then the rigidity (spring constant) of the cockling is represented as $$\frac{48EI}{(1/f)^3}.$$

Suppression of cockling requires a pressing member (here, the first fixing roller 186) to be always pressed against the recording medium 122, and therefore this value $$\frac{48EI}{(1/f)^3}$$

is the lower limit of the spring constant k of the compressive spring 200 serving as the pushing member. This is the meaning of the left-hand side of Expression 1.

The right-hand side of Expression 1 is largely determined on the basis of experimentation, the part $$\frac{2A}{t} \cdot \frac{48EI}{(1/f)^3}$$

therein represents the ratio between the forces required to achieve deformation corresponding to the thickness t of the recording medium 122 and deformation corresponding to the amplitude A of the cockling, and the conveyance speed v is further taken into consideration. If the spring constant k exceeds the upper limit, then the suppression of cockling is too strong and there is a risk of adversely producing severe creasing in the recording medium 122.

It is thus possible to effectively suppress cockling without producing severe creasing, by pushing the first fixing roller 186, which is the member pressing the recording medium 122, by means of the compressive spring 200 having the spring constant k that satisfies the conditions in the above-described Expression 1.

Here, the first fixing roller 186, which presses the recording medium 122, can be an elastic member such as a rubber roller, for example, but does not necessarily have to be an elastic member, and can also be a simple metal roller, for instance.

Furthermore, since the extent of cockling (undulation) varies with the amount of ink deposited on the recording medium 122, the pushing force of the compressive spring 200 applied to the first fixing roller 186 is adjusted in accordance with the extent of cockling by the compression amount control unit 202. This adjustment is made by the system controller 82 predicting the cockling that is likely to occur in the recording medium 122 from the acquired image data and controlling the compression amount control unit 202 on this basis so as to control the amount of compression of the compressive spring 200. In this case, the amount of compression of the compressive spring 200 can be automatically controlled. Alternatively, it is also possible that the system controller 82 predicts the amplitude and frequency of cockling, then calculates a target adjusted amount of compression in accordance with the prediction, and reports the result to the user. The reporting device may employ a display on a display screen of the host computer 96, for example, or a sound message. In this case, the operator manually adjusts the amount of compression of the compressive spring 200, on the basis of the reported amount of compression indicated in the screen display or sound message.

In the embodiment described above, the compressive spring 200 serves as the pushing member for pushing the pressing member (here, the first fixing roller 186); however, the pushing member is not subject to particular restrictions, and another device may be used provided that it is capable of adjusting the pushing force applied to the pressing member.

For example, the pushing member can be a pneumatic spring that operates using pressurized air. In this case, as shown in FIG. 6, the system controller 82 is connected to a pump control unit 214, which controls a pump 212 that adjusts the amount of air in the pneumatic spring 210. The pump 212 is controlled by the system controller 82 through the pump control unit 214, so as to adjust the pushing force of the pneumatic spring 210.

In this case, the spring constant k of the pneumatic spring 210 should also satisfy the conditions in Expression 1. Therefore, in the case of the spring constant k of the pneumatic spring 210, the amplitude and frequency of cockling are predicted in the system controller 82 similarly to the case of the compressive spring 200 described above, a suitable spring constant value is calculated on the basis of this prediction, and the spring constant of the pneumatic spring 210 is automatically adjusted on the basis of this suitable spring constant value, or this value is reported to the user and the spring constant of the pneumatic spring 210 is manually adjusted by the user.

Next, the experimental results achieved in actual practice are described.

The recording paper used here was gloss paper having the thickness of 0.1 mm, the width of 636 mm, and the flexural rigidity of 355 N·mm$^2$. The cockling occurring in this case had an amplitude of 2.5 mm, and a frequency in the conveyance direction of the recording medium of 0.02 (1/mm). The conveyance speed of the recording paper was 500 mm/s. From the foregoing, the range of the spring constant k (N/mm) calculated by Expression 1 is as indicated in the following Expression 2:

$$0.136<k<152. \quad (2)$$

The obtained experimental results are shown in Table 1 below.

TABLE 1

| Spring constant (N/mm) | Effect in suppressing cockling | Severe creasing |
|---|---|---|
| No spring | Small | No |
| 15 | Medium | No |
| 50 | Medium | No |
| 110 | Large | No |
| 170 | Large | Yes |

As Table 1 shows, when there was no spring, no severe creasing occurred, but there was small effect in suppressing cockling. As the spring constant k became greater, the effect in suppressing cockling became greater; however, when the spring constant was too large (more specifically, 170), severe creasing occurred.

Consequently, it is desirable that the spring constant should be as high as possible to produce a large effect in suppressing cockling, within a range that does not produce severe creasing. It is then desirable that the spring constant is not smaller than 50% of the upper limit of the spring constant k in Expression 2, and more desirably, not smaller than 80% of the upper limit.

As described in detail above, according to the present embodiment, it is possible to suppress cockling in a recording medium, which occurs due to deposition of ink, in a suitable manner without producing severe creasing due to excessive suppression.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A recording apparatus, comprising:

an image forming device which deposits ink onto a recoding medium to form an image;

a conveyance device which conveys the recording medium in a recording medium conveyance direction at a recording medium conveyance speed;

a pressing member which presses the recording medium on which the ink has been deposited, onto the conveyance device; and a pushing device which pushes the pressing member to press the recording medium to suppress cockling occurring in the recording medium on which the ink has been deposited, the pushing device having a spring constant k that satisfies:

$$\frac{48EI}{(1/f)^3} < k < \sqrt{v} \cdot \frac{2A}{t} \cdot \frac{48EI}{(1/f)^3},$$

where EI is a flexural rigidity of the recording medium, t is a thickness of the recording medium, v is the recording medium conveyance speed, A is an amplitude of the cockling in the recording medium, and f is a frequency of the cockling in the recording medium along the recording medium conveyance direction.

2. The recording apparatus as defined in claim 1, wherein the pressing member is constituted of an elastic member.

3. The recording apparatus as defined in claim 1, wherein the pressing member is constituted of a rubber roller.

4. The recording apparatus as defined in claim 1, wherein the pressing member is constituted of a metal roller.

5. The recording apparatus as defined in claim 1, wherein the pressing member is constituted of a fixing roller which applies heat to the recording medium to fix the image formed on the recording medium.

6. The recording apparatus as defined in claim 5, wherein a temperature of the fixing roller is adjustable by means of a heat source disposed inside the fixing roller.

7. The recording apparatus as defined in claim 5, wherein a temperature of the fixing roller is adjustable by means of a heat source disposed outside the fixing roller.

8. The recording apparatus as defined in claim 1, further comprising a pushing force control device which adjusts a pushing force of the pushing device to control a pressing force of the pressing member applied to the recording medium.

9. The recording apparatus as defined in claim 1, wherein the pushing device is constituted of a compressive spring.

10. The recording apparatus as defined in claim 9, further comprising a compression amount control device which adjusts an amount of compression of the compressive spring to control a pressing force of the pressing member applied to the recording medium.

11. The recording apparatus as defined in claim 1, wherein the pushing device is constituted of a pneumatic spring.

12. The recording apparatus as defined in claim 11, further comprising a pump control device which adjusts amount of air in the pneumatic spring to control a pressing force of the pressing member applied to the recording medium.

13. The recording apparatus as defined in claim 1, further comprising a spring constant value calculation device which receives image data of the image to be formed on the recording medium, predicts the amplitude and frequency of the cockling occurring after the ink is deposited to form the image in accordance with the image data, and calculates a spring constant value corresponding to the predicted amplitude and frequency of the cockling.

14. The recording apparatus as defined in claim 13, further comprising a reporting device which reports the calculated spring constant value to a user.

15. The recording apparatus as defined in claim 14, wherein the spring constant of the pushing device is manually adjustable by the user in accordance with the calculated spring constant value.

16. The recording apparatus as defined in claim 14, wherein the pushing device is constituted of a pneumatic spring of which the spring constant is manually adjustable by the user in accordance with the calculated spring constant value.

17. The recording apparatus as defined in claim 13, wherein the spring constant of the pushing device is automatically adjusted in accordance with the calculated spring constant value.

18. The recording apparatus as defined in claim 13, wherein the pushing device is constituted of a pneumatic spring of which the spring constant is automatically adjusted in accordance with the calculated spring constant value.

19. The recording apparatus as defined in claim 1, wherein the spring constant k of the pushing device satisfies:

$$0.5 \cdot \sqrt{v} \cdot \frac{2A}{t} \cdot \frac{48EI}{(1/f)^3} \leq k.$$

20. The recording apparatus as defined in claim 19, wherein the spring constant k of the pushing device satisfies:

$$0.8 \cdot \sqrt{v} \cdot \frac{2A}{t} \cdot \frac{48EI}{(1/f)^3} \leq k.$$

* * * * *